US011072986B2

(12) United States Patent
Cleven

(10) Patent No.: US 11,072,986 B2
(45) **Date of Patent: *Jul. 27, 2021**

(54) RESETTABLE PRESSURE ACTIVATED DEVICE

(71) Applicant: COMITT WELL SOLUTIONS US HOLDING INC., Katy, TX (US)

(72) Inventor: Peter Kris Cleven, Grand-Barachois (CA)

(73) Assignee: COMITT WELL SOLUTIONS US HOLDING INC., Katy, TX (US)

( * ) Notice: Subject to any disclaimer, the term of this patent is extended or adjusted under 35 U.S.C. 154(b) by 114 days.

This patent is subject to a terminal disclaimer.

(21) Appl. No.: 16/382,809

(22) Filed: Apr. 12, 2019

(65) Prior Publication Data

US 2019/0242214 A1 Aug. 8, 2019

Related U.S. Application Data

(63) Continuation of application No. 15/888,183, filed on Feb. 5, 2018, now Pat. No. 10,301,906, which is a continuation of application No. PCT/US2016/050305, filed on Sep. 3, 2016.

(51) Int. Cl.
*E21B 23/06* (2006.01)

(52) U.S. Cl.
CPC ..... *E21B 23/06* (2013.01)

(58) Field of Classification Search
CPC ..... E21B 23/06
See application file for complete search history.

(56) References Cited

U.S. PATENT DOCUMENTS 3,850,238 A * 11/1974 Hill ..... E21B 34/16 166/374
5,803,177 A * 9/1998 Hriscu ..... E21B 33/126 166/142

* cited by examiner

*Primary Examiner* — Robert E Fuller
(74) *Attorney, Agent, or Firm* — Pierson Intellectual Property LLC

(57) ABSTRACT

A resettable pressure activated device, comprises an inner wall, a return spring, a resilient element and an axially movable piston arranged around the inner wall. The piston comprises a radially extending piston area in fluid communication with a central bore within the inner wall such that the piston moves in an activation direction when a bore pressure within the central bore exceeds the pressure around the device by a predetermined release pressure.

12 Claims, 3 Drawing Sheets

RESETTABLE PRESSURE ACTIVATED DEVICE

BACKGROUND

Field of the Invention

The present invention relates to tools for use in a wellbore. More particularly, the invention concerns a resettable pressure activated device.

Prior and Related Art

In some applications, for example stimulating a reservoir with several zones, it saves time and money to stimulate the zones during one trip, i.e. to insert a string into a wellbore and stimulate several zones one after the other before pulling back the string.

In such applications, packers must be set to isolate the pertinent zone, then an injection valve must open to allow a flow of injectant from the string into the zone. After stimulation, the packers and valve(s) must return to an idle state such that the packer and valve assembly may move to the next zone where the procedure is repeated, or such that the string may be pulled out of the wellbore. The idle state is also known as the run-in state.

When the string moves in the wellbore, there is a risk that pressure activated equipment, e.g. a packer, a valve or an anchor, activates prematurely, for example at a bore pressure of 200 bar, while the intended equipment should be activated at a higher bore pressure, e.g. above 600-1000 bar depending on the application at hand.

A general objective of the present invention is to overcome at least one of the problems above while retaining the benefits of prior art. A more specific objective is to provide an improved device for setting a release pressure. A further objective is to provide a standard device for setting the release pressure for a packer, valve or anchor, or a combination of such pressure activated equipment.

SUMMARY OF THE INVENTION

The above objectives are achieved by a device according to claim 1.

More particularly, the invention provides a resettable pressure activated device comprising an inner wall, a return spring, a retaining element and an axially movable piston arranged around the inner wall. The piston comprises a radially extending piston area in fluid communication with a central bore within the inner wall such that the piston moves in an activation direction when a bore pressure within the central bore exceeds the pressure around the device by a predetermined release pressure. The return spring is configured to provide a return force that is directed opposite the activation direction and has a magnitude sufficient to return the piston to an idle position when the bore pressure drops below a predetermined reset level. The resilient element provides a retaining force equal to the difference between the release force and the return force.

The piston area depends on the string, in particular an inner diameter defining the central bore, the outer diameter of the string and wall thicknesses. For a given piston area, the desired release pressure multiplied by the piston area gives a release force. Thus, the combined forces from the return spring and the resilient element must be equal to the release force to activate pressure activated well equipment, e.g. a packer, valve or anchor. The reset force provided by the return spring, i.e. stiffness multiplied by extension, may be less than the release force. The resilient force may be, for example, be a friction that is proportional to a radial force provided by the resilient element. The design permits a limited set of return springs, each suited for one or more string diameters, and a finite set of resilient elements or an adjustable resilient element to provide the retaining force, i.e. the difference between the release and reset forces.

In preferred embodiments, the return spring is mounted between a shoulder on the inner wall and the piston. This permits a compact design.

The return spring may be compressed when the piston moves in the activation direction. It follows that the return spring alternatively may be extended when the piston moves in the activation direction. Either way, the return spring has one end fixed relative to the inner wall and outer housing and another end fixed relative to the piston.

In some embodiments, the resilient element is a collet finger. Several collet fingers may be disposed around the circumference of the piston, and collectively provide the retaining force. Alternatively, the resilient element may be, for example, a helical spring or a Belleville washer providing the required radial force.

In embodiments with one or more collet fingers, each or all collet fingers comprises a tapered end configured to remove debris when the piston returns to its idle position.

In some embodiments, regardless of whether they comprise collet fingers or other resilient elements, the resilient element is connected to a retaining element configured to fit in a groove in the piston. The groove may extend around the circumference, and thus form a continuous shoulder. Alternatively, the groove may comprise several discrete grooves distributed around the circumference of the piston. Either way, the retaining element must overcome the radial force from the resilient element in order to exit the groove from the idle state. When the piston returns, a smaller reset force may slide the retaining element back to the groove.

In preferred embodiments, the device further comprises adjustment means for adjusting the force acting from the retaining element on the piston. This permits an adjustable release pressure for a given string diameter and a standardized return spring.

The adjustment means may adjust a radial distance between the inner wall and the retaining element. For example, collet fingers may be configured to squeeze more or less on the piston by screws through each finger or a band around the fingers. In general, adjusting the radial distance pre-compresses the resilient element, thereby providing an adjustable retaining force. The adjustment means preferably comprise a rotatable threaded member such as an adjustment screw extending through collet fingers to threads in the inner wall or a threaded lid in a bore with a helical spring or Belleville washer.

Preferably, the device further comprises a filter between the central bore and the piston area. The filter prevents that sand or other solid particles from the central bore enters the region where the piston slides.

Further features and benefits will become apparent from the dependent claims and the detailed description.

BRIEF DESCRIPTION OF THE DRAWINGS

The invention will be explained by means of exemplary embodiments with reference to the drawings, in which.

DETAILED DESCRIPTION

The drawings are schematic to illustrate the principles of the invention, and are not necessarily to scale. Numerous details known to one of ordinary skill in the art are omitted from the drawings and the following description. The resettable pressure activated device is shown setting and unsetting a packer 130, but it should be appreciated that the packer 130 may be replaced by a sliding sleeve or an anchor.

Figure 1:
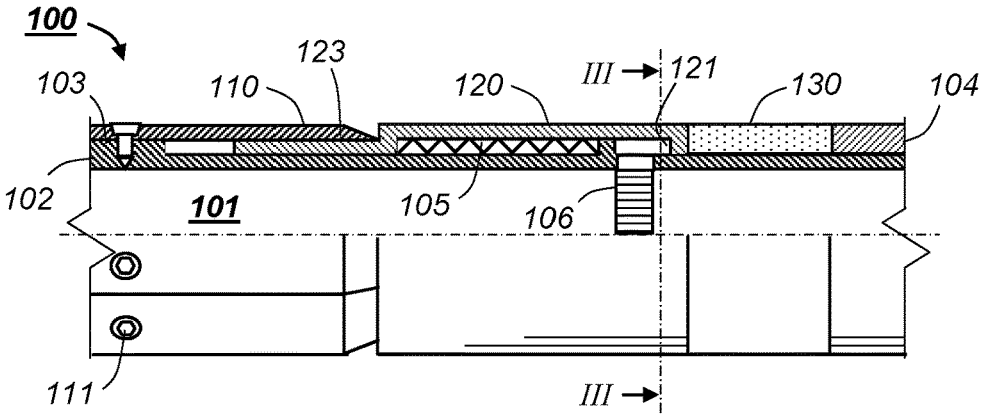
FIG. 1 is a schematic view of a first embodiment in an idle state.

FIG. 1 illustrates a resettable pressure activated device 100 in an idle or run-in state. The device 100 has rotational symmetry, of which 90° of the circumference is removed for illustrative purposes. See FIG. 3. The device 100 comprises a central bore 101 surrounded by an inner wall 102. The inner wall has a cylindrical outer face 103 with an extended outer diameter. An axially movable piston 120 is arranged around the inner wall 102 in a section with less outer diameter than the face 103. The piston 120 comprises a radially extending piston area 121 in fluid communication with the central bore 101 through a filter 106. A release pressure within the central bore 101 causes the piston 120 to move in an activation direction to the position illustrated in FIG. 2.

Figure 2:
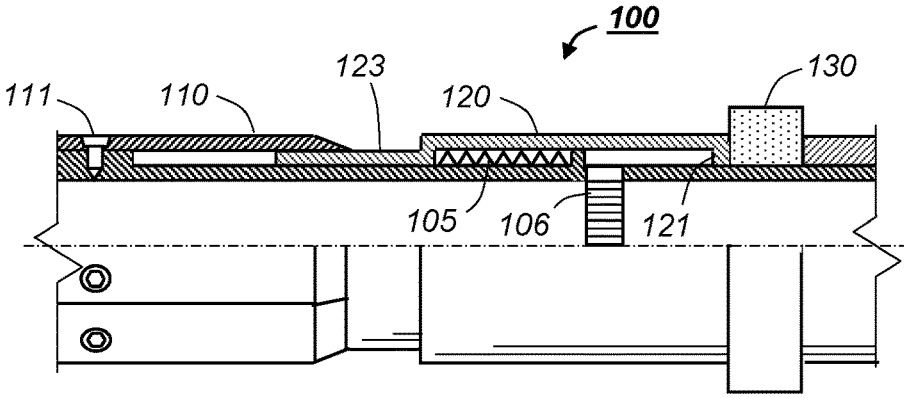
FIG. 2 shows the device in FIG. 1 during operation.

FIG. 2 shows the device from FIG. 1 in an activated state wherein the piston 120 is displaced from its idle position in FIG. 1 to an activated position. In the present example, the axial displacement of piston 120 has caused an elastic packer element 130 to expand radially between the piston 120 and an outer housing 104, which is fixed with respect to the inner wall 102. A similar axial displacement of a piston 120 could displace a sliding sleeve to open or close a valve, or set an anchor rather than the packer element 130.

A return spring 105 provides a return force on the piston 120. The return force is directed opposite the activation direction, and has a magnitude equal to a stiffness times a displacement from equilibrium (Hooke's law). The return force has a magnitude sufficient to return the piston 120 to the idle position shown in FIG. 1 when the bore pressure drops below a predetermined reset level.

In the figures, the spring 105 abuts a shoulder on the inner wall 102 and is contracted when the piston 120 moves in the activation direction. Embodiments where the spring 105 is extended and/or has a fixed end attached to the inner wall 102 or outer housing 104 are obvious because an extended spring provides the same return force as a contracted spring with the same stiffness, and because there is no axial displacement or rotation between the inner wall 102 and the outer housing 104.

A resilient element 110 exerts a retaining force on the piston 120, such that the piston 120 moves from the idle position in FIG. 1 if and only if the bore pressure acting on the piston area 121 overcomes the combined force provided by the return spring 105 and the resilient element 110. In FIGS. 1 and 2, radially biased collet fingers represent the resilient element 110. Alternatives will be discussed with reference to FIG. 6.

In a first embodiment shown in FIGS. 1 and 2, several resilient collet fingers 110 provide a radial spring force on a sliding face 123 on the piston 120. The retaining force is a friction force proportional to this radial spring force. More particularly, the friction force may be subdivided into a static friction force when the outer face 123 does not move relative to the collet fingers 110, and a somewhat smaller dynamic friction force when the outer face 123 moves axially relative to the collet fingers 110. The static and dynamic friction forces are proportional to the radial bias provided by the collet fingers 110.

In preferred embodiments, the retaining force is adjusted by adjustment means 111. In FIGS. 1 and 2, the outer diameter of the face 103 is assumed to be slightly smaller than the outer diameter of the sliding face 123 on the piston 120. Thus, the radial bias from the resilient collet fingers 110, and hence the retaining force, may be adjusted by tightening or loosening the adjustment screws 111. Obviously, one clamping band at the same axial position as the illustrated adjustment screws 111 would have the same effect.

The space between the collet fingers 110 is not fluid tight. If it was, external pressure would add to the bias, and hence make the retaining force dependent of the depth at which the device 100 is deployed.

The collet fingers 110 have tapered ends in order to remove debris when the piston 120 returns to its idle position. If desired, the piston 120 may have a similar tapered face.

Figure 3:
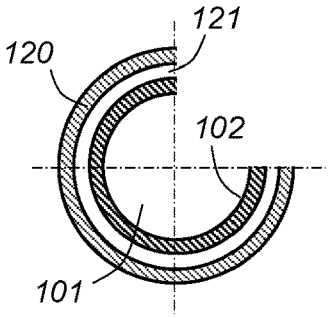
FIG. 3 is a cross section along the plane III-III in FIG. 1.

FIG. 3 is a cross section along the plane III-III in FIG. 1. The surface facing the central bore 101, i.e. the inner face of the inner wall 102, is preferably cylindrical along the entire device in all embodiments. For simplicity, the outer surface of wall 102 is also shown as a perfect circle. However, the inner wall 102 may be provided with axial grooves or protrusions, and the piston 120 may be provided with complementary axial protrusions or grooves. Either way, axially extending protrusion(s) and/or groove(s) prevent relative rotation between the inner wall 102 and the piston 120 about the axis of rotational symmetry, i.e. the crossing point of the axes in FIG. 3.

Figure 4:
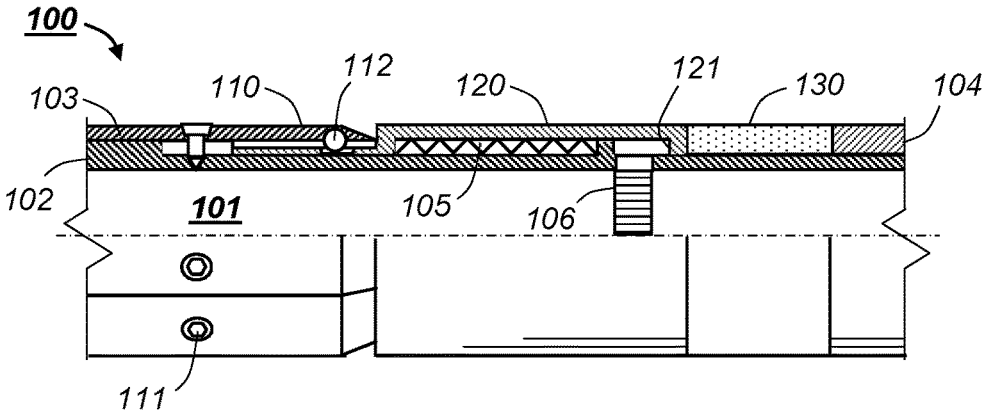
FIG. 4 is a schematic view of a second embodiment in an idle state.
Figure 5:
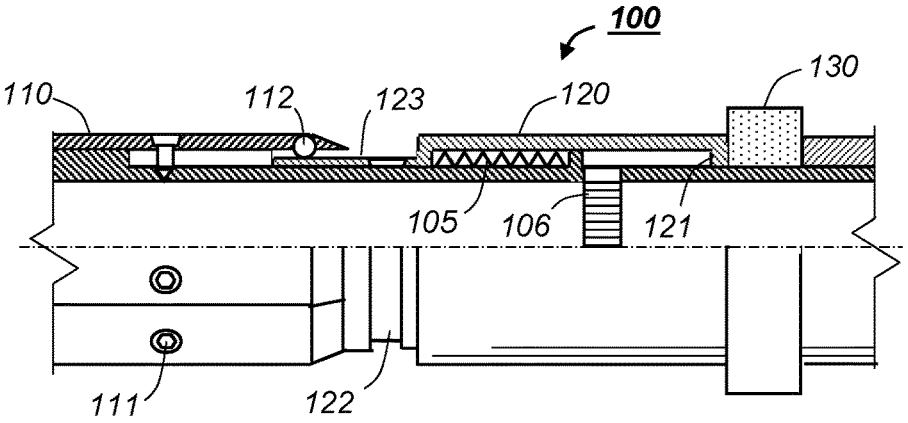
FIG. 5 shows the device in FIG. 4 during operation.

FIGS. 4 and 5 show a second embodiment of the invention in an idle and operational state, respectively. In the second embodiment, the outer diameter of the face 103 is somewhat larger than the outer diameter of the sliding face 123 on the piston 120, and the adjustment screws 111 are displaced axially from the outer face 103 with larger diameter. The effect of the adjustment screws 111 and alternative adjustment means is to adjust the radial bias from the resilient collet fingers 110, and hence the retaining force, as described above.

In the exemplary embodiment shown in FIGS. 4 and 5, a separate retaining element 112 is provided on the springy collet fingers 110. In FIG. 4, the retaining element 112 is received in a complementary groove 122 on the piston 120. Thus, a radial spring force must be overcome for the retaining element 112 to exit the groove 122. This permits a more precise and/or convenient setting of a release pressure than depending on a static friction as in the first embodiment. The annular groove 122 shown in FIGS. 4 and 5 may be replaced by several discrete grooves 122 as shown in FIG. 7.

The remaining elements in FIGS. 4 and 5, e.g. the piston 120 with piston area 121, the return spring 105, filter 106 and packer 130, are recognized from FIGS. 1 and 2, and need no repeated explanation here.

Figure 6:
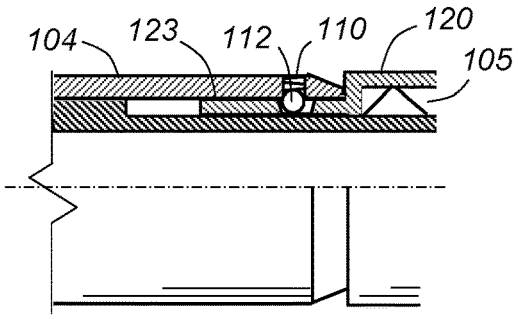
FIG. 6 is a schematic partial view of a third embodiment in an idle state.
Figure 7:
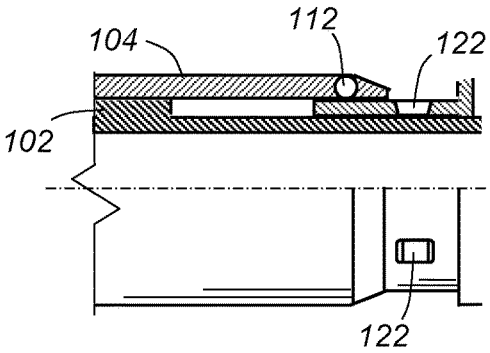
FIG. 7 shows the detail in FIG. 6 during operation.

FIGS. 6 and 7 illustrate a third embodiment in which the resilient collet fingers are replaced by a rigid outer housing 104. In particular, FIGS. 6 and 7 show only the leftmost section of devices 100 otherwise similar to the devices shown in FIGS. 1-5, as there is no need to show the return spring 105 and other details once more.

In the third exemplary embodiment, the resilient element 110 is represented by a helical spring that is compressed when the retaining element 112 moves radially outward from the groove 122 to slide or roll on the sliding face 123 of the piston 120. It should be understood that the resilient element 110 may be any element, e.g. a collet finger, a leaf spring, a helical spring or a Belleville washer, as long as it provides a radial spring force of suitable magnitude and directed radially toward the piston 120. Further, the spring 110 may be more or less pre-compressed by adjustment means, e.g. threaded lids (not shown), to provide an adjustable force on the retaining element 112.

In FIG. 7, the retaining element 112 slides or rolls on the sliding face 123. If the retaining element 112 stops in this position in the operational state, it is readily seen that the retaining element 122 offers little resistance when the return spring 105 returns the piston 120 to its idle position shown in FIG. 6. However, embodiments where the retaining element 112 slips behind a shoulder, e.g. the left hand edge of piston 120 in FIG. 7, in the operational state are anticipated.

FIG. 7 also illustrates that the annular grove 122 shown in FIG. 5 may be replaced with several discrete grooves 122 distributed around the circumference of the piston 120.

Figure 8:
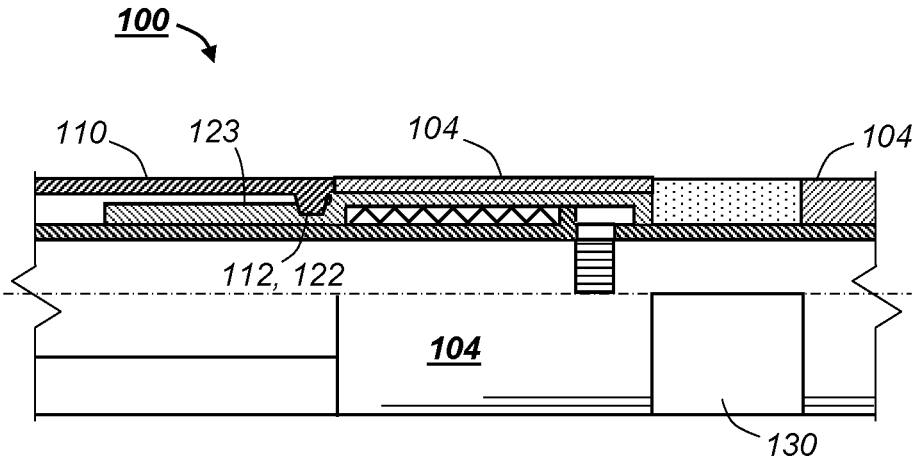
FIG. 8 is a schematic view of a fourth embodiment in an idle state.
Figure 9:
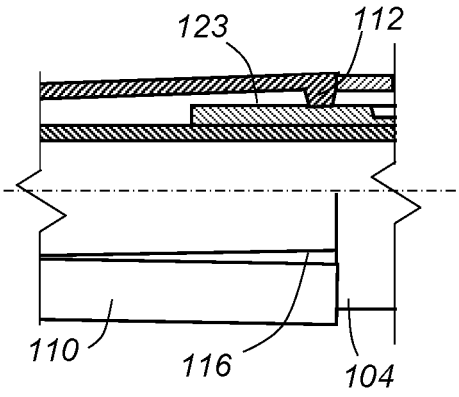
FIG. 9 shows a detail of the device in FIG. 8 during operation.

In the examples provided so far, the piston 120 has formed part of the outer surface of the device 100. FIGS. 8 and 9 illustrate a fourth embodiment, in which the outer housing 104 extends over the piston 120. The main benefit is that sand and debris outside the device 100 is prevented from entering the region where the piston 120 slides back and forth. Thus, the embodiment in FIGS. 8 and 9 could advantageously be combined with the embodiment shown in FIGS. 6 and 7. However, FIGS. 8 and 9 are also intended to illustrate that collet fingers 110 flare out, and thereby form wedge shaped openings 116 in the operational state. Obviously, sand and debris may also enter the region with moving parts through the openings 116, or lodge between the collet fingers. Both of these conditions may prevent the device 100 from returning to the idle state shown in FIG. 8.

Figure 10:
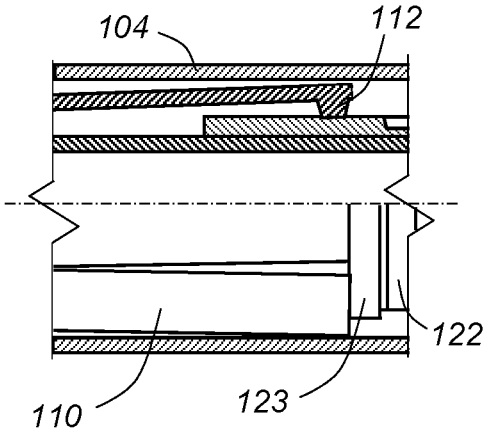
FIG. 10 illustrates a fifth embodiment.

FIG. 10 illustrates a fifth embodiment, in which the collet fingers in FIG. 9 are enclosed to in the outer housing 104. The reader is reminded that the drawings are schematic, and thus that the relative thicknesses of the housing, collet fingers, piston and inner wall are not intended to be realistic in FIG. 10.

It is considered obvious for one skilled in the art to combine elements from the illustrated examples. For example, the spring 110 and retaining element 112 from FIG. 6 could easily replace the resilient collet fingers 110 with protrusion 112 in FIG. 10. The collet fingers may be attached to the piston rather than to the inner wall 102, and be oriented opposite to the direction shown in the drawings, and still provide the same effect. Similarly, complementary elements such as retaining elements and grooves may be configured opposite to what is shown in the drawings.

In short, the invention has been described by way of examples. However, the scope of the invention is determined by the accompanying claims.

What is claimed is:

1. A pressure activated device comprising:

an inner wall with a first shoulder extending away from a central axis of the pressure activated device;

a piston with a second shoulder extending towards the central axis of the pressure activated device, wherein a piston area is formed on the second shoulder, the piston moving while the inner wall remains static, the piston being a sliding sleeve positioned radially outside of the inner wall;

a filter positioned between a central bore of the pressure activated device, the piston area, and the first shoulder, wherein the piston further includes a third shoulder extending towards the central axis of the pressure activated device, the third shoulder decreases the inner diameter of the piston; and a spring contacting the first shoulder and the third shoulder.

2. The pressure activated device of claim 1, further comprising:

collet fingers including a tapered end, wherein the tapered end is configured to remove debris from a sliding face of the piston, wherein the sliding face is positioned on an end of the piston, and the sliding face is configured to move axially relative to the tapered end.

3. The pressure activated device of claim 2, further comprising:

adjustment means configured to adjust a radial force applied by the collet fingers against the sliding face.

4. The pressure activated device of claim 1, wherein the piston area is in fluid communication of the central bore, and a minimum inner diameter of the piston being larger than a minimum inner diameter of the inner wall.

5. A pressure activated device comprising:

an inner wall with a first shoulder extending away from a central axis of the pressure activated device;

a piston with a second shoulder extending towards the central axis of the pressure activated device, wherein a piston area is formed on the second shoulder, the piston moving while the inner wall remains static, the piston being a sliding sleeve positioned radially outside of the inner wall;

a filter positioned between a central bore of the pressure activated device, the piston area, and the first shoulder, wherein the piston includes a third shoulder extending towards the central axis of the pressure activated device, the third shoulder decreases the inner diameter of the piston, wherein a first chamber is formed between the first shoulder and the second shoulder, wherein a first size of the first chamber is variable, wherein a second chamber is formed between the third shoulder and the first shoulder, wherein a second size of the second chamber increases when the first size of the first chamber decreases.

6. A pressure activated device comprising:

an inner wall with a first shoulder extending away from a central axis of the pressure activated device;

a piston with a second shoulder extending towards the central axis of the pressure activated device, wherein a piston area is formed on the second shoulder, the piston moving while the inner wall remains static, the piston being a sliding sleeve positioned radially outside of the inner wall;

a filter positioned between a central bore of the pressure activated device, the piston area, and the first shoulder, wherein the piston is configured to move towards a distal end of the pressure activated device responsive to increasing a pressure above a pressure threshold, wherein the first shoulder increases an outer diameter of the inner wall, wherein the second shoulder decreases an inner diameter of the piston, a maximum outer diameter of the piston being larger than a maximum outer diameter of the inner wall, wherein the piston is configured to move towards a proximal end of the pressure activated device responsive to decreasing the pressure below the pressure threshold.

7. A method of using a pressure activated device comprising:

forming a first shoulder on an inner wall, the first shoulder extending away from a central axis of the pressure activated device;

forming a piston with a second shoulder, the second shoulder extending towards the central axis of the pressure activated device, wherein a piston area is formed on the second shoulder;

moving the piston while the inner wall remains static, the piston being a sliding sleeve positioned radially outside of the inner wall;

positioning a filter between a central bore of the pressure activated device, the piston area, and the first shoulder, wherein the piston further includes a third shoulder extending towards the central axis of the pressure activated device, wherein the third shoulder decreases the inner diameter of the piston;

positioning a spring between the first shoulder and the third shoulder, wherein a first end of the spring contacts the first shoulder and a second end of the spring contacts the third shoulder.

8. The method of claim 7, further comprising:

removing debris from a sliding face of the piston via collet fingers with a tapered end, the sliding face moving axially relative to the tapered end.

9. The method of claim 8, further comprising:

adjusting a radial force applied by the collet fingers against the sliding face.

10. The method of claim 7, wherein the piston area is in fluid communication of the central bore, and a minimum inner diameter of the piston being larger than a minimum inner diameter of the inner wall.

11. A method of using a pressure activated device comprising:

forming a first shoulder on an inner wall, the first shoulder extending away from a central axis of the pressure activated device;

forming a piston with a second shoulder, the second shoulder extending towards the central axis of the pressure activated device, wherein a piston area is formed on the second shoulder;

moving the piston while the inner wall remains static, the piston being a sliding sleeve positioned radially outside of the inner wall;

positioning a filter between a central bore of the pressure activated device, the piston area, and the first shoulder, wherein the piston further includes a third shoulder extending towards the central axis of the pressure activated device, wherein the third shoulder decreases the inner diameter of the piston;

forming a first chamber between the first shoulder and the second shoulder, wherein a first size of the first chamber is variable; and forming a second chamber between the third shoulder and the first shoulder, wherein a second size of the second chamber increases when the first size of the first chamber decreases.

12. A method of using a pressure activated device comprising:

forming a first shoulder on an inner wall, the first shoulder extending away from a central axis of the pressure activated device;

forming a piston with a second shoulder, the second shoulder extending towards the central axis of the pressure activated device, wherein a piston area is formed on the second shoulder;

moving the piston while the inner wall remains static, the piston being a sliding sleeve positioned radially outside of the inner wall;

positioning a filter between a central bore of the pressure activated device, the piston area, and the first shoulder;

moving the piston towards a distal end of the pressure activated device responsive to increasing a pressure above a pressure threshold, wherein the first shoulder increases an outer diameter of the inner wall, wherein the second shoulder decreases an inner diameter of the piston, a maximum outer diameter of the piston being larger than a maximum outer diameter of the inner wall; and moving the piston towards a proximal end of the pressure activated device responsive to decreasing the pressure below the pressure threshold.

* * * * *